United States Patent [19]

Kervefors et al.

[11] Patent Number: 4,938,387

[45] Date of Patent: Jul. 3, 1990

[54] DEVICE FOR SELECTIVELY DISPENSING AND MIXING A PLURALITY OF BEVERAGES

[75] Inventors: Stig Kervefors, Ekerö ; Gösta Söderström, Johanneshov; Hans Krook, Sollentuna, all of Sweden

[73] Assignee: Drinx Production AB, Taby, Sweden

[21] Appl. No.: 286,253

[22] Filed: Dec. 19, 1988

[51] Int. Cl.[5] ..... B67D 5/56

[52] U.S. Cl. ..... 222/129.4; 222/144.5; 222/490; 141/376

[58] Field of Search ..... 222/129.4, 129, 132, 222/135, 137, 144.5, 145, 490, 213; 141/363, 364, 375, 376, 370, 371

[56] References Cited

U.S. PATENT DOCUMENTS

| | | | |
|---|---|---|---|
| 2,469,746 | 5/1949 | Sanchis | 141/376 |
| 3,608,793 | 9/1971 | VanLabensals | 222/490 |
| 4,096,972 | 6/1978 | Bartels et al. | 222/144.5 |
| 4,162,028 | 7/1979 | Reichenberger | 222/129.4 |
| 4,217,941 | 8/1980 | Catalano | 141/375 |
| 4,276,999 | 7/1981 | Reichenberger | 222/129.4 |
| 4,433,795 | 2/1984 | Maiefski et al. | 222/144.5 |
| 4,821,925 | 4/1989 | Wiley et al. | 222/129.4 |

FOREIGN PATENT DOCUMENTS

| | | | |
|---|---|---|---|
| 2808183 | 9/1979 | Fed. Rep. of Germany | 222/135 |
| 99572 | 8/1940 | Sweden | 222/490 |

OTHER PUBLICATIONS

Published PCT application of Meyer, WO 85/04157, PCT/US85/00417, Int. Publication Date Sep. 1985.

*Primary Examiner*—Michael S. Huppert
*Assistant Examiner*—Kenneth Noland
*Attorney, Agent, or Firm*—Cushman, Darby & Cushman

[57] ABSTRACT

A device for selectively dispensing and mixing a plurality of beverages, having separately for each beverage a storage unit a pump unit and a dispensing unit, the units for each beverage are connected in series by pipe conduits, the dispensing units being combined to a bundle to dispense and mix the beverages in selected quantities and combinations in a receptacle, such as a drinking-glass, in order to prevent admittance of air both into the storage units and the dispensing units, and to prevent after-dripping and incorrect dispensing. Each storage unit comprises an intermediate storage unit provided between a storage container and a respective pump unit and arranged to receive a volume of beverage larger than the volume dispensable on each operation by the pump unit via the dispensing unit. Each dispensing unit comprises a dispensing nozzle of resilient material and actuable by the pressure from the pump unit only.

27 Claims, 6 Drawing Sheets

DEVICE FOR SELECTIVELY DISPENSING AND MIXING A PLURALITY OF BEVERAGES

BACKGROUND OF THE INVENTION

This invention relates to devices for dispensing and mixing a plurality of beverages. An example of a prior art device of this type is disclosed in U.S. Pat. No. 4,162,028 to Reichenberger.

A prerequisite for the satisfactory function of such a device is that the beverages can relatively quickly be dispensed and mixed in a distinct manner and in correct quantities without subsequent dripping. This has heretofore not been achieved without problems. Owing to the fact that the discharge openings below which the drinking-glasses are to be placed, are not allowed to have a total cross-sectional area larger than the glass, there is at the discharge openings no room for any valve means to positively open and close the flow of liquid from the pumps or the bottle supply, resulting in that after-dripping with consequent inaccurate metering cannot be completely eliminated in the known devices. At the after-dripping there is also difficult to prevent air from being admitted into the conduit system and from interfering with the function of the device. For this reason, it has heretofore been avoided to dispense beverages having high contents of sugar, such as liqueurs, which, exposed to air during evaporation form crystalline sugar that clogs conduits and valves etc. Moreover, when in known devices a bottle is emptied during dispensing, air may also be admitted into the system from the supply side thereof, not only resulting in inaccurate dispensing but also in interruption of operation for time-consuming venting and refilling of the system.

It is therefore an object of the invention to provide a device for selectively dispensing and mixing a plurality of beverages, which device eliminates the above discussed problems of air-admission and after-dripping present in prior art devices.

SUMMARY OF THE INVENTION

According to the invention there is provided a device for selectively dispensing and mixing a plurality of beverages, having separately for each beverage a storage unit, a pump unit and a dispensing unit, said units for each beverage being coupled in series by pipe conduits, the dispensing units being combined to a bundle to dispense and mix the beverages in selected quantities and combinations into a receptacle, such as a drinking-glass, wherein each storage unit comprises an intermediate storage unit provided between a storage container and a respective pump unit and arranged to receive a volume of beverage larger than the volume dispensable by the pump unit via said dispensing unit on each operation, and wherein each dispensing unit comprises a dispensing nozzle of resilient material and openable by the pressure from said pump unit only.

By the provision of an intermediate storage unit between each storage container and the respective pump unit, whereby the intermediate storage unit is arranged to receive a volume of beverage larger than the volume dispensable by the pump unit on each operation, any admission of air into the conduit system is prevented during the pump stroke emptying the respective bottle or storage container, so that the operator not has to fear any admission of air into the system on the dispensing operation emptying the bottle or the storage container concerned. In addition, by the provision of each dispensing unit comprising a dispensing nozzle of resilient material and openable solely by the pressure from said pump unit, there is no occurrence of after-dripping or air admittance at the dispensing units.

BRIEF DESCRIPTION OF THE DRAWING

Other objects and preferred embodiments of the invention are given in the appended claims and in the following description with reference to the drawings.

In the various embodiments shown on the drawing corresponding parts have been given substantially same reference numerals.

DETAILED DESCRIPTION

Figure 1:
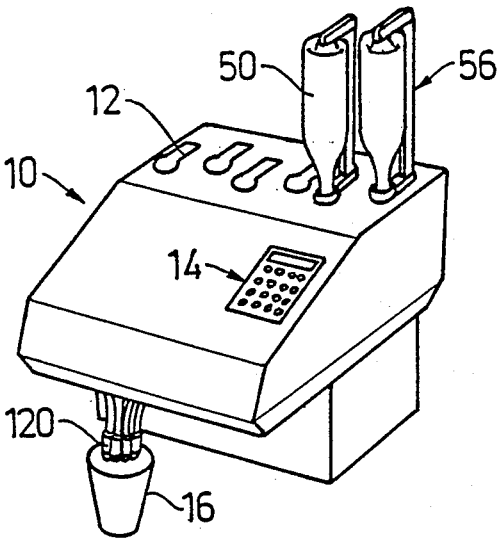
FIG. 1 is a perspective view of a dispensing and mixing device provided as a drink-dispensing apparatus.

In the example shown in FIG. 1, the dispensing and mixing device according to the invention is shown as a drink-dispensing apparatus 10 arranged to be placed for example on a counter in a bar. On top of the apparatus 10 are provided a plurality of openings 12. Into each opening 12 a holder 56 for an inverted bottle 50 can be inserted. From a push-button panel 14 on the apparatus a plurality of combinations of beverages contained in the bottles 50 can be selected to mixingly dispense the beverages through the dispensing nozzles 120 into a drinking-glass 16. As described in more detail in the following, to the apparatus 10 there can be coupled additional bottles or other types of beverage containers.

Figure 2:
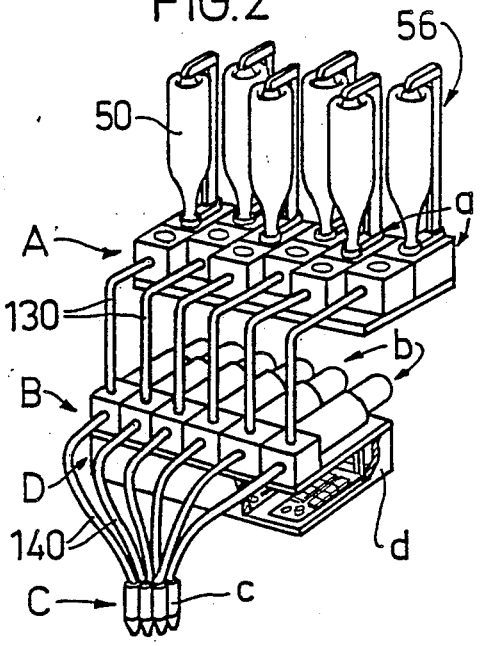
FIG. 2 is a perspective view of the interior of an apparatus substantially according to FIG. 1.
Figure 3:
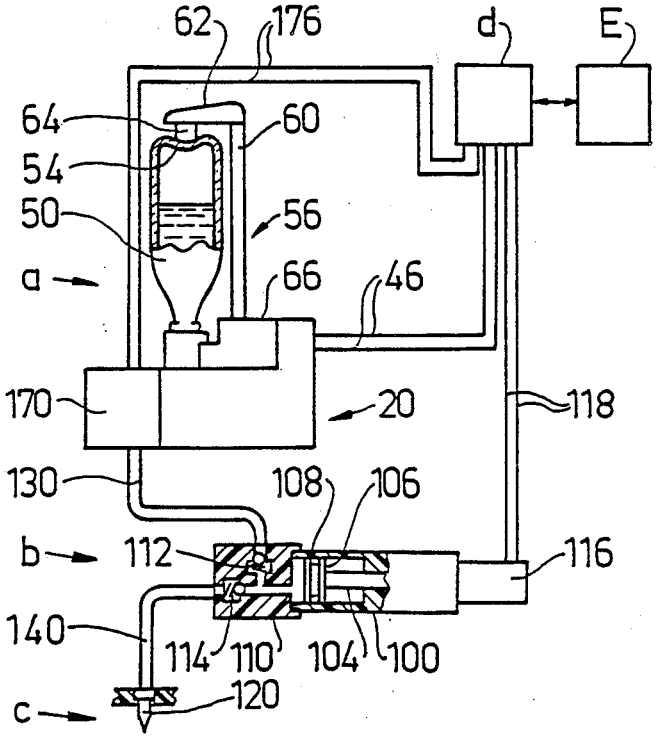
FIG. 3 is a diagrammatic lateral view showing main components related to each of the beverages to be dispensed.

As shown in FIG. 2 and 3, there is in the apparatus for each beverage provided a storage unit a, a pump unit b and a dispensing unit c, which units are coupled in series by pipe conduits 130 and 140, respectively. As is also evident from FIG. 2, for each function the module-shaped units a, b, c are arranged in parallel in a storage block A, a pump block B, and a dispensing block C, respectively. In FIG. 3, there is schematically also shown a control and power unit d which is preferably provided separately for each beverage. As indicated in FIG. 2, also these units d can be assembled in a block D, for example in connection with the pump units b. As shown in FIG. 3, the separate control and power units d are in turn supervised and controlled by a central processing unit E, such as a programmable computer.

Figure 4:
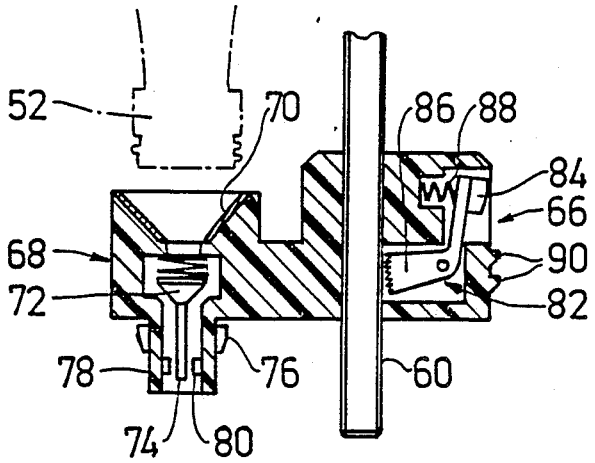
FIGS. 4, 5 and 6 are partial sectional views of various storage units.
Figure 5:
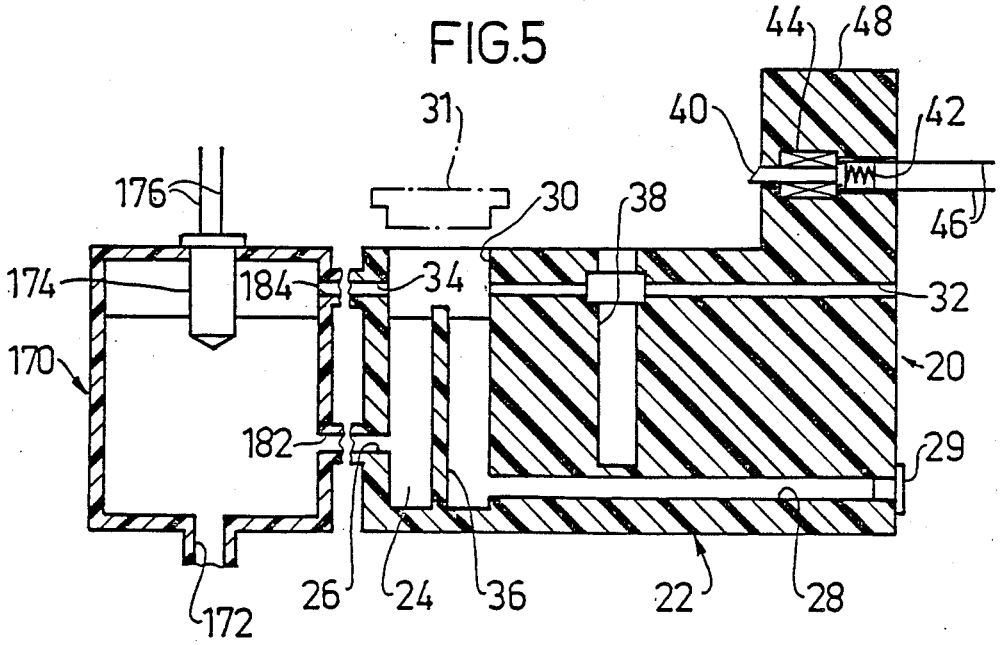

Each storage unit a comprises the above-mentioned bottle holder 56 and an intermediate storage unit 20, which are shown in more detail in FIGS. 4 and 5, respectively.

With reference to FIG. 5, each intermediate storage unit 20 has a rectangular block-shaped inlet housing 22 and a storage vessel 170 being preferably releasably mounted to the inlet housing 22 and also being block-shaped. The inlet housing 22 comprises an inner space 24 having an upwardly facing inlet opening 30. From the lower portion of the lateral opposite sides of the housing 22, an inlet passage 28 and an outlet passage 24 extend horizontally into the space 24, and from the upper portion of said opposite sides a pair of venting passages 32 and 34 also extend horizontally into the space 24. The outlet passage 26 and the venting passage 34 are in communication with the interior of the storage vessel 170 through respective corresponding openings 182 and 184. If desired, the inlet passage 28 can be connected via a pipe conduit (not shown) to a remote supply of beverages, or can otherwise be sealed by a sealing plug 29. The inlet opening 30 can in a similar way be sealed by a sealing plug 31. The intermediate storage unit 20 is in communication with the corresponding pump unit through an outlet opening 172 on the storage vessel 170.

In the inlet housing 22 there is also provided a vertical guide channel 38 arranged to slidingly receive a free end of a shaft 60 (FIG. 4) of the bottle holder 56 (FIG. 1–3) being formed as a clamp. On the shaft 60 a fixed leg 62 is provided, having a retaining element 64 preferably made from rubber material for engagement with the concave bottom 52 of the bottle 50 to be clamped in the holder 56. A slidable member 66 on the shaft 60 is in engagement with the neck opening 52 (FIG. 4) of the bottle 50. The slidable member 66 has a locking mechanism 82 in engagement with the shaft 60, and the locking mechanism has a detent 86 urged to locking engagement with the shaft 60 by a compression spring 88. The detent allows sliding of the member 66 in a direction clamping the bottle 50 but prevents sliding in the opposite direction. The locking mechanism 82 can be released by manual actuation of a push button 84 recessed in the slidable member 66. On its bottle-receiving portion opposite to the locking mechanism 82, the slidable member 66 has an outlet portion 68 comprising an outwardly flared mouth 70 facing the opening 52 of the bottle 50 and comprising a valve member 72, spring-biased in a closing direction. The face of the conical or flared mouth 70 is preferably coated by soft rubber material to provide a good sealing against the rim of the bottle-neck opening 52. On its end facing the inlet housing 22, the outlet portion 68 is provided with a hollow pipe portion 78 arranged to extend a distance into the inner space 24 when the bottle holder is mounted on the inlet housing 22. The valve member 72 has an axial extension 74 extending into the pipe portion 78 and adapted to be brought into engagement with a fixed projection 36 in the space 24 or with the bottom (not shown) of this space to open the valve member 72 when the bottle holder is mounted on the inlet housing 22. In the interior of the hollow pipe portion 78 guiding means 80 can be mounted, preventing tilting of the axial extension 74. Around the pipe portion 78 is also mounted an annular sealing ring 76 for sealing against the inlet opening 30 of the inlet housing 22.

As shown in FIGS. 4 and 5, the inlet housing 22 and the slidable member 66 of the bottle housing are provided with interengaging latch means comprising respectively a springbiased latch bolt 40 and a pair of fixed locking projections 90. The latch bolt 40, axially urged by spring 42 to locking engagement, is mounted in an upwardly projecting rear portion 48 of the inlet housing 22 and is provided with an electromagnet 44 by means of which it can be retracted against the force of the spring 42 on excitation from control and power unit d (FIG. 3) via electric leads 46. The latch bolt 40 and/or the fixed locking projections 90 formed on the bottle holder 56 have one side bevelled, so as to allow insertion but not removal of the bottle holder when electromagnet 44 is not excited. With the bottle holder mounted, the push button 84 is concealed by the rear portion 48 of the inlet housing 22 to prevent removal of bottle 50 in the locked state.

Figure 6:
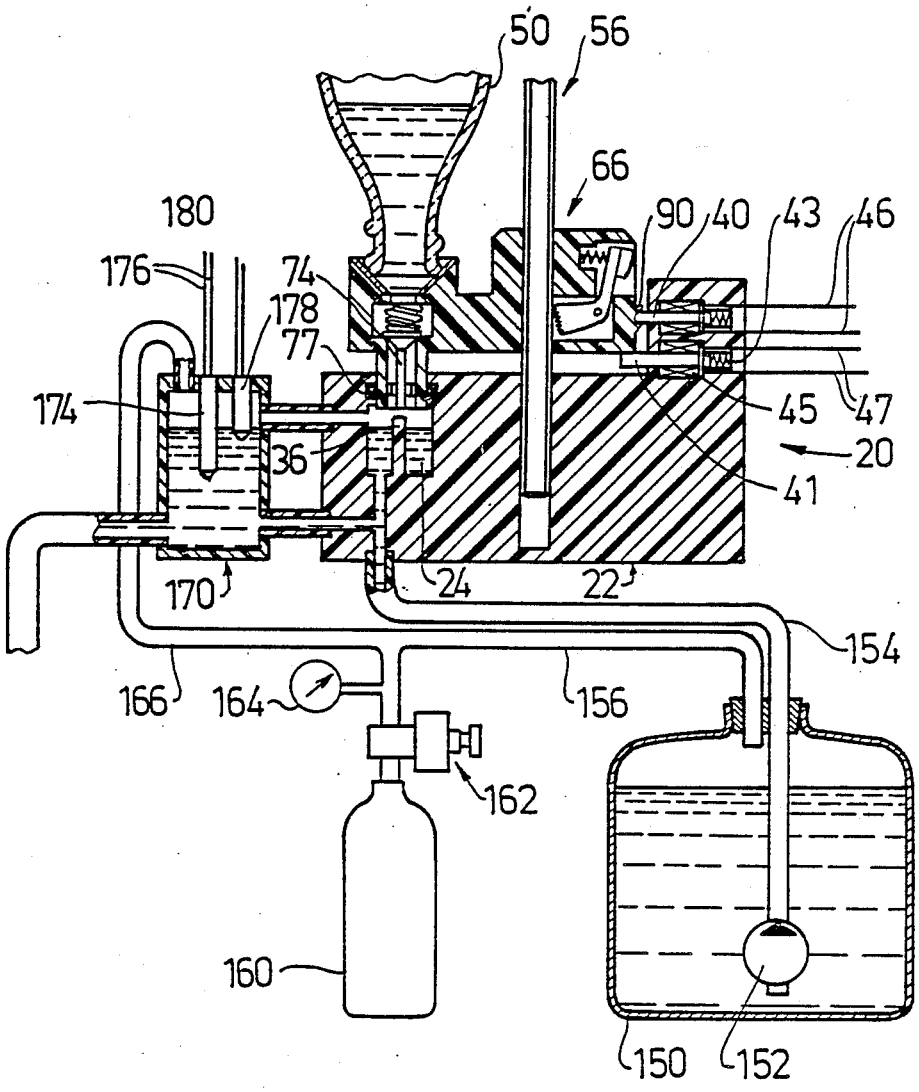

FIG. 6 shows diagrammatically an alternative embodiment of an intermediate storage unit 20. In this embodiment, the inlet housing 22 has an additional spring-biased and electromagnetically actuable bolt 41. In this case, the bolt 41 does not serve as a latch bolt but as a retaining means for supporting the slidable member 66 of the bottle holder in a stand-by position in which the axial extension 74 of valve member is out of engagement with a fixed projection 36. By excitation of the electromagnet 45 for the bolt 41, the latter is retracted against action from the spring 43 whereby the bottle holder falls into working position while the latch bolt 40 moves into engagement with the next locking projection 90. In this case the annular sealing 77 between pipe portion 78 of bottle holder 56 and inlet opening 30 of space 24 may instead be mounted in the inlet opening 30 to provide sealing also in the stand-by position.

Figure 7:
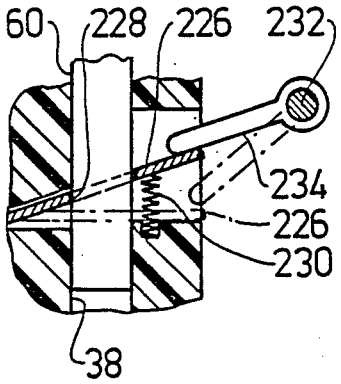
FIG. 7 is a partial sectional view of a locking mechanism.

With reference to FIG. 7, in lieu of the locking mechanisms previously described, a flexible or pivotable arresting plate 226 can be used having a rectangular aperture 228 which has a length slightly exceeding the width of shaft 60, receives shaft 60 and is urged in a direction arresting the shaft 60 by means of a spring 230. The arresting plate 226, thereby exerting a wedging action on the shaft 60, allows the shaft 60 to be pushed into the guide channel 38 under slight resistance from the spring force, into the stand-by position or the fully inserted position, but prevents withdrawal of shaft 60. Arresting plate 226 can be released by being pushed against the spring force to the position shown by phantom lines in FIG. 7, either by hand, or as shown, by engagement of a finger 234 fixedly mounted on a swinging axle 232. The swinging axle 232 can have a plurality of fingers (not shown), i.e. one finger for each one of the inlet housings laterally mounted in a storage block.

Figure 8:
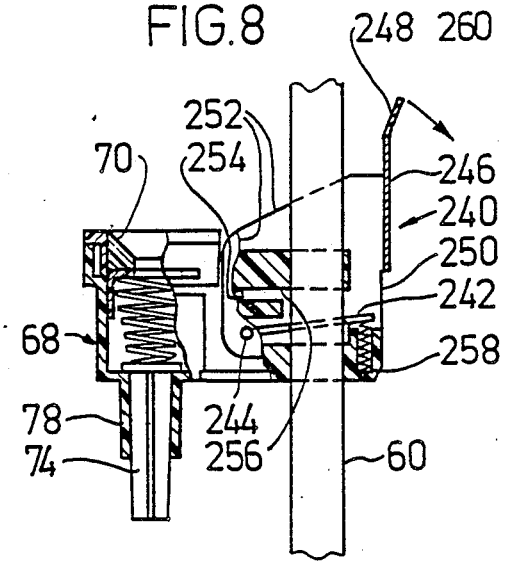
FIG. 8 is a partial sectional view of a modified bottle holder.

With reference to FIG. 8, there is shown a preferred embodiment of a bottle holder having a slidable member 240 also arranged to receive and arrest the shaft 60 by means of an arresting plate 242, and also acting in a wedging manner. In this case one end of the arresting plate 242 is pivotably connected through a pivot 244 to the opposite faces 252 of a metal sheet member 246 folded to a handle portion 248 and having a bottom recess 250 in order to be free from the shaft 60 in a fully turned-out position. A guiding pin 254 extending between the opposite faces 252 of sheet member 246, is secured thereto at a distance from the pivot 244, and is guided in a guiding slot 256 oriented perpendicular to the shaft 60. As in FIG. 7, a compression spring 258 acts on the opposite end of the arresting plate 242. In the arresting state shown, the guiding pin 254 is in engagement with the upper face of guiding slots 256 and urges the underlying end of arresting plate 242 downwardly for arresting engagement with the shaft 60. When releasing shaft 60, the handle portion 248 is turned out around pivot 244 whereby the guiding pin 254, guided in slot 256, initially passes a top dead center position vertically above the pivot 244 and then, during movement to the right in FIG. 8 within slot 256, forcibly lifts the pivot 244 and thereby also the respective end of arresting plate 242, thereby loosening the engagement of the arresting plate 242 with the shaft 60. By this arrangement there is also obtained a very advantageous after-clamping of a bottle mounted in the bottle holder: In the released state with the handle portion 248 fully turned out, the arresting plate will be oriented in a horizontal position, at the one end lifted by the pivot 244, and at the other end lifted by the compression spring 258. When pivoted into the arresting position, the arresting plate 242 arrests shaft 60 a short distance before guiding pin 254 has reached said top dead center position. At the continuing movement of the guiding pin 254 towards the top dead center position the arresting plate 242 will be displaced downwards, without reorientation thereof, against the force of spring 258, carrying with it the shaft 60. The final portion of the movement of guiding pin 254 beyond the top dead center position thereby serves to ensure the locking action.

Figure 9:
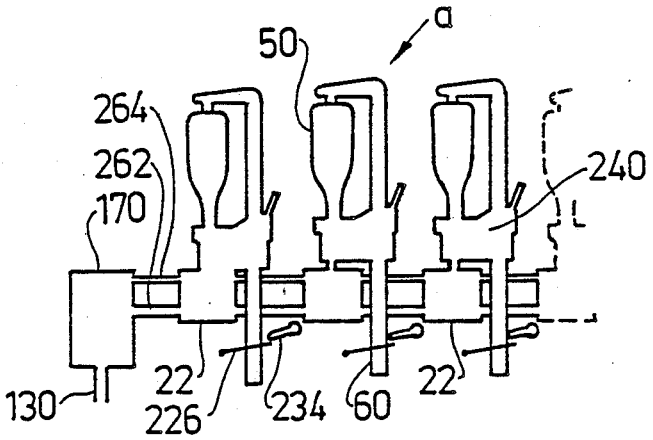
FIG. 9 is a diagrammatic view of a storage unit having a plurality of inlet housings connected in series.

The different blocks A to D need not to be situated at the same place, as shown in FIG. 2, but can be placed as desired by extension of conduits 130, 140; a storage block A, for example, can be located adjacent to a wall behind the counter in a bar, while the dispensing block C and possibly a pump block B are located in the proximity of the counter. In this case, as indicated in FIG. 9, when the beverages are stored in bottles, each storage unit a can be provided with a plurality of inlet housings 22 interconnected to each other and to the respective intermediate storage vessels 170 through liquid conduits 262, and through venting conduits 264. In FIG. 9 the shafts 60 of the bottle holders are shown arrested in fully inserted positions, and in stand-by positions, by means of locking mechanisms of the type shown in FIG. 7. In this case the locking mechanisms are not provided on the inlet housings 22, but on an underlying support structure (not shown).

FIG. 6 shows an intermediate storage unit 20, via a pipe conduit 154, also being connected to a remote storage container 150 which can be used instead of, or, as shown, together with a bottle 50 mounted in the bottle holder 56. The storage container 150 can be provided with a feeding pump 152, but its contents can also, as the contents of the bottles, be fed into the inlet housing 22 by gravitation. In the embodiment shown on FIG. 6, not the surrounding air, but a gas, preferably an inert gas such as nitrogen, from a separate pressure source in the form of gas bottle 160, is used for venting of the intermediate storage unit 20 and the storage containers 50, 150. From the gas bottle 160, pipe conduits 166 and 156 extend through a control valve 162 into respectively the storage vessel 170 and the storage container 150. This closed venting arrangement prevents the beverage from being brought into contact with and from being oxidized by oxygen in the air or from being otherwise detoriated as to flavour and taste, whereby opened bottles containing for example wine can be stored in the apparatus for long periods of time.

Within the storage vessel 170 shown on FIG. 5, is according to the invention provided a level indicator 174 of a kind known per se and arranged to indicate via power and signal leads when the bottle 50 mounted in the bottle holder 56 on the inlet housing 27 is empty. The level indicator 174 comprises a casing having a conical tip permeable to light, whereby a light-emitting diode, preferably an IR-diode transmitting infra-red light, and a photo diode, preferably a IR-detector, are mounted in the casing. As long as the tip of indicator 174 is immersed in liquid, the light from the light-emitting diode is refracted into the liquid, while when the liquid surface is beneath the tip the light will undergo total reflection in the tip and be directed back to the photo diode as a result of the change in refractive index of the surrounding medium, whereby a bottle-replacement signal is transmitted from the level indicator 174 to the control and power unit d via the leads 176. Within the storage vessel 170 shown on FIG. 6, an additional similar level indicator 178 is mounted. This level indicator is adapted to indicate via power and signal leads 180 when the liquid surface reaches an upper level in the intermediate storage unit 20, or in the storage vessel 170, to temporarily inactivate the feeding pump 152 or to otherwise temporarily stop the liquid flow from a remote storage container.

Returning to FIG. 3, each pump unit b comprises an axial piston pump incorporating a pump cylinder 100, a valve housing 110, and a drive assembly 116.

Figure 10:
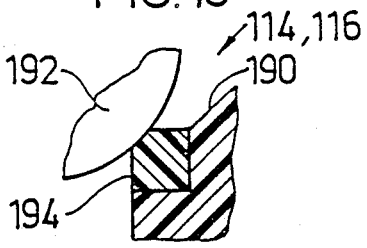
FIG. 10 is a partial sectional view of a check valve.

Within the pump cylinder 100 which can be made from a suitable plastics material, such as PTFE, is provided a piston rod 104 having a piston 106 and an annular sealing 108, such as an O-ring sealing member. Within the valve housing 110, also made from plastics material, is arranged in a manner known per se a pair of spring-biased check valves 112 and 114. As indicated in FIG. 10, an annular sealing 194 of relatively soft rubber-elastic material can be arranged between the valve seat 190 and the valve member 192 of check valves 114, 116. The use of such annular sealing has been shown to provide an excellent check valve function, even when pumping beverages containing solid constituents such as fruit-flesh and crystalline sugar that otherwise might disturb the valve function. The valve housing 110 is also box-shaped having a larger cross-section than the pump cylinder 100 to allow a modular assembly and possible interconnection with valve housings of remaining pump units b to a pump block B, as shown in FIG. 2.

Through an actuation means (not shown), for example a screw and nut assembly, piston rod 104 of pump cylinder 100 is connected to an electric step motor 116 receiving drive pulses via electric leads 118 from control and power unit d.

FIGS. 11 to 15 show different views of a dispensing nozzle 120 to be used in a dispensing and mixing device according to the invention.

Figure 14:
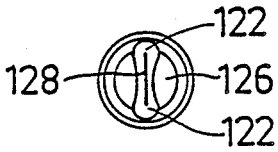
Figure 15:
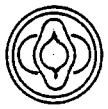

The nozzle 120 which can be made of a suitable elastic material such as soft plastics or rubber material, preferably silicone rubber, has substantially at the inlet end 134, the general shape of a circular cylindrical sleeve at the outlet end 124 transforming into a flattened bill-shaped cross-section. More precisely, the otherwise substantially circular cylindrical nozzle 120 is defined by a pair of diametrically opposed flat wall portions 126 converging towards the outlet end 124 and sealingly contacting each other over an axial length l at the inside of the outlet opening, forming a gap 128 openable by liquid pressure. As is evident from FIG. 14, the gap 128 is on its opposite ends defined by a pair of thickened material portions or beads 122 extending at least over the length l and providing a resilient resistance against opening of gap 128, owing to the material accumulated in the beads 122. FIGS. 14 and 15 show the nozzle in the state opened by the pressure of the discharging liquid.

Figure 11:
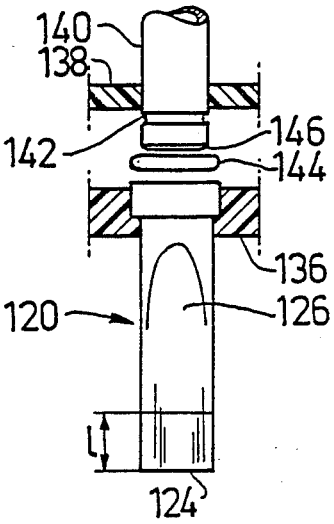
FIGS. 11 to 15 are different views of a dispensing nozzle according to the invention.
Figure 12:
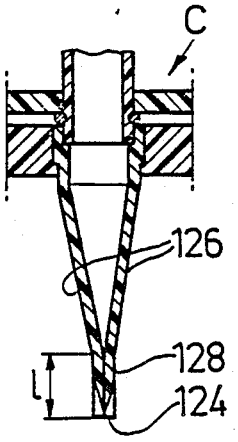

FIGS. 11 and 12 also show the connection of one of the nozzles to a corresponding pipe conduit 140 in the dispensing block C. The dispensing unit c comprises a lower plate 136 having holes for reception of an upper flange portion 132 of each nozzle 120 to be mounted in the dispensing block C, and also comprises an upper plate 138 having holes for the reception of a corresponding pipe conduit 140. The mutually aligned opening of plates 136, 138 are arranged in a dense circular pattern (not shown) in order to hold together in a bundle a plurality (e.g. 7, 19 or 37) nozzles 120. Adjacent to outlet end of pipe conduit 140 is formed an outer peripheral recess 142 into which a closed or split retaining ring 144, is mounted after insertion of conduit end through opening in upper plate 138. Pipe conduit 140 is now secured against withdrawal from plate 138. Next, the conduit end potion, tapered at 146, is inserted in the flange portion 132 of nozzle 120 for abutment against a shoulder 134 in the nozzle inlet end. (Shoulder 134 can be omitted.) The plates 136, 138 are finally interconnected, for example by inter-engaging snap lock means.

Figure 16:
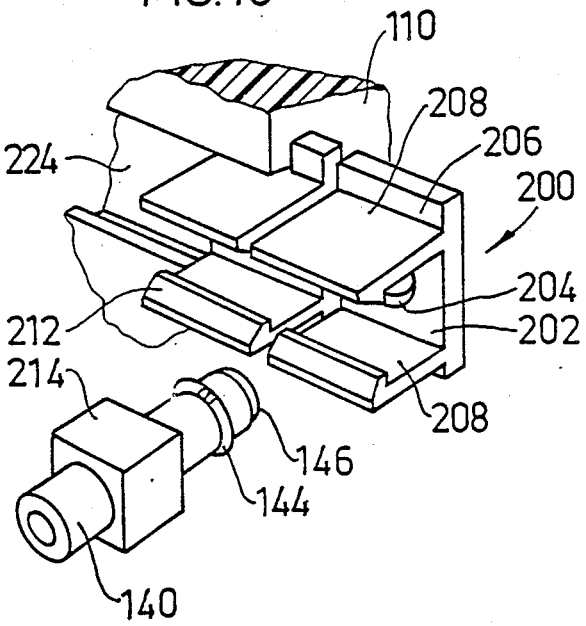
FIGS. 16 and 17 are a perspective view and a sectional view respectively, showing a portion of a pipe coupling arrangement for a device according to the invention.
Figure 17:
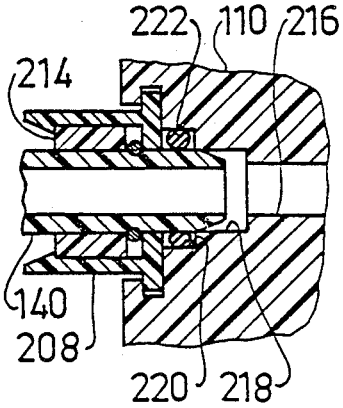

With reference to FIGS. 16 and 17, there is shown how the other pipe conduit terminal ends, in a way essentially as above can be connected to the remaining module components of the apparatus, for example to pump unit valve housing 110. The terminal end of conduit 140, as in FIG. 11 also having a retaining ring 144 and a taper 146, is in this case fastened to the house 110 by means of a releasable coupling arrangement comprising a generally U-shaped retainer 200 having a rectangular base with a central aperture 204 therein and a pair of resilient opposed locking lugs 208 extending from the base and on their end portions formed with detents 210, and also comprising a cube-shaped snap-in member 214 to be held in the retainer 200. Projecting from base 202 in opposite directions beyond lugs 208 are flanges 206 arranged to be slidably inserted into an under-cut open channel 224 formed in the housing 110. The passage 216 to be connected to pipe conduit 140 and terminating in the under-cut channel 224, has in the end portion thereof a pair of consecutive counterbores 218, 220 of which a first counterbore 218 receives end of conduit 140 and the second, 220, receives an O-ring sealing member 222. During assembly, retainer 200 is first inserted into under-cut channel 224, whereupon end of conduit 140 with cube-shaped member 214 and retaining ring 144 mounted thereto is inserted in the retainer such that retaining ring 144 is in engagement with the rim of aperture 204, and finally cube-shaped member is snapped in between lugs 204 to the position shown in FIG. 17. On disassembly, the resilient lugs 208 are brought apart allowing cube-shaped member 214 to be released, whereupon components are removed in the reverse manner.

Figure 18:
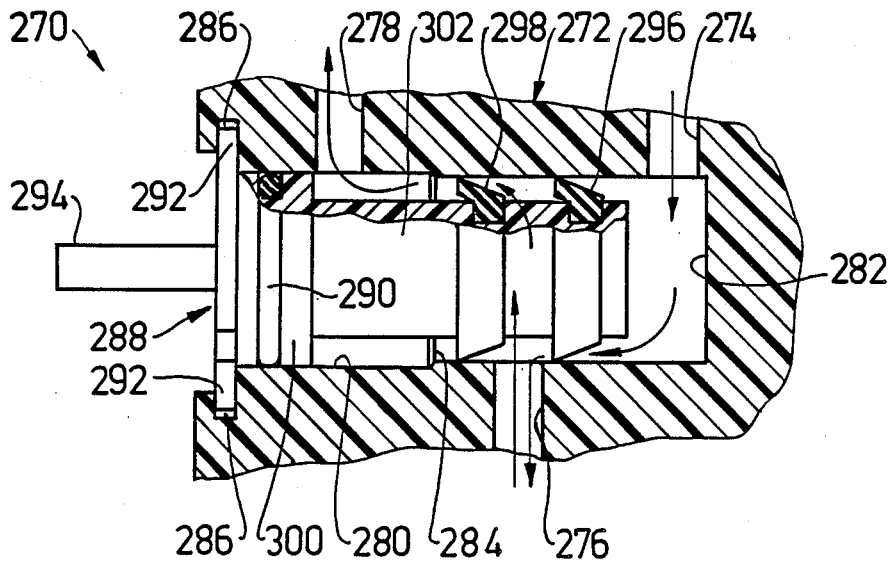
FIG. 18 is a partial lateral view, partly in section, showing a valve assembly for a device according to the invention.

According to a realized embodiment of the invention, the check valves 112, 114 diagrammatically shown in FIG. 3 can be formed as a plug-in type valve assembly 270 shown in FIG. 18. Valve assembly 270 comprises a housing 272 and a valve member 288 insertable therein. A bore 280 within the housing has a open end and a bottom 282. Radially extending into the bore 280 and axially spaced are an inlet port 274, a pumping port 276 and an outlet port 278. The reduced diameter, at 284, for tightening engagement of later described check valves 296, 298 is not necessary for proper function of valve assembly 270. The valve member 288 is composed of the following components: a cylindrical shaft 302 having less diameter than the bore 280; a guiding and sealing portion 300 having a diameter corresponding to the diameter of the bore 280 and an O-ring seal 290; a pair of retaining flanges 292, 292 for engagement with complementary retaining channels 286, 286 at the exterior of housing 272 by turning of the valve member 288; a handle 294 for mounting and removal of the valve member 288; and, mounted on the shaft 292, a pair of check valves 296, 298, single-acting like sealing lips and in the shape of sleeve gaskets made of suitable rubber material, such as nitrile or silicone rubber. As evident from the arrows shown in FIG. 18, the check valve 296 will allow liquid inflow only, from inlet port 274 to the pump port 276 on each suction stroke of a pump piston (such as 106, FIG. 3) while the check valve 298 will allow liquid outflow only, from the pumping port 276 to the outlet port 278 on each subsequent pump stroke of the pump piston.

Compared to a previous valve member devised and tested by the applicant, wherein the check valves were composed of conventional ball check valves within the valve member, the valve member shown in FIG. 18 has, inter alia, the following substantial advantages: A more reliable and a much more simplified construction having a number of about 16 less components; an almost "static" working mode owing to that the annular opening section of the check valves are located on maximum diameter (increased from 6 mm to 22 mm); a more reliable sealing function with a larger allowable variation of tolerances in the sealing area; and easier to clean by having to be wiped off on the outside only.

The operation of a dispensing and mixing apparatus according to the invention is as follows:

It is assumed that bottles 50 and/or other types of storage containers 150 are connected to the apparatus, for example as shown in FIGS. 2, 6, and 9. If the apparatus or some of the components thereof, for example after replacement or addition of components, are taken into operation for the first time, the liquid flowing into the system will displace the air and fill the intermediate storage vessel to the maximum level determined either by the position of the lower end of hollow pipe portion 78 (FIG. 4) or by the level indicator 178 (FIG. 6) which via the respective control and power unit d and the processing unit E stops operation of feeding pump 152 when indicator 178 comes in contact with the liquid. In case air is present also in pump unit B and in dispensing unit C (FIG. 3), also these units are vented by a few strokes of pump piston 106. On the following retraction of pump piston 106, the beverage is admitted from conduit 130 into check valve 112, while on the following forward stroke of pump piston 106, check valve 112 closes and the beverage is allowed to discharge from check valve 114 into conduit 140 and to dispensing nozzle 120. According to the invention, after each dispensing operation, the pump piston 106 is caused to be returned to a fully retracted position in the pump cylinder 100, whereby the beverage is present within the pump cylinder prior to the following dispensing operation. In this way, besides the provision of a very quick dispensing, any crystalline sugar, which otherwise might interfere with the function of the pump, cannot be deposited at the rear side of the pump piston 106 when pumping sugar-rich beverages. Prior to venting of the system, the pump piston 106 may however be programmed to be extended to its fully extended position to minimize the amount of air to be expelled from the system.

The liquid volume contained in the intermediate storage unit 20 and conduit 130 is according to the invention at least equivalent to the stroke volume or displacement of the pump, whereby there is no risk for the entrance of air into the system during the forward and backward pump strokes emptying a storage container or bottle 50. By dividing the intermediate storage unit 20 into inlet housings 22 and storage vessels 170, separated for example as in FIG. 9 by finer vent conduits 264 and coarse liquid conduits 262, there is also eliminated the possibily of streams of air bubbles on their way to replace the liquid displaced from a storage container from being captured by the liquid flowing into the pump unit; any air bubbles captured by liquid flow from the inlet housing 22 will rise to the surface in the storage vessel 170.

The amount of dispensed beverage, i.e. the volume displaced on extension of pump piston 106, is determined by a certain number of drive pulses to the step motor 116 from the respective control and power unit d, which in turn receives control commands from an input panel, such as push-button panel 14 in FIG. 1, via the processing unit E in which programs for predetermined compositions of beverages to be recalled from the input panel can be stored.

Figure 13:
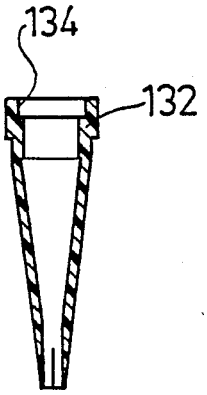

When the beverages metered by the pump units B enter the nozzles 120 of dispensing units c, these latter are opened by liquid pressure from the state shown in FIGS. 12 and 14 to the state shown in FIGS. 13 and 15, so that the different beverages are positively mixed with each other when striking the inside bottom of the drinking-glass 16 (FIG. 1) placed under the nozzles. The nozzles 120 are closed immediately when the respective pump pistons 106 stops the forward stroke thereof so that no after-dripping is allowed. Owing to the excellent closing action of nozzle 120, there is also possible to omit the check valve 114, especially in cases when outlet conduit 140 is relatively short.

A device according to the invention can be modified and arranged in many different ways within the scope of the appended claims. For example, a plurality of storage blocks can be connected to one pump block through branch conduits.

We claim:

1. A device for selectively dispensing and mixing a plurality of beverages, having separately for each beverage a storage unit, a pump unit and a dispensing unit, said units for each beverage being connected in series by pipe conduits, each storage unit comprising an intermediate storage unit provided between a storage container and a respective pump unit and arranged to receive a volume of beverage larger than the volume dispensable on each operation by the pump unit via said dispensing unit, and said dispensing units being combined so as to provide a bundle to dispense and mix the beverages in selected quantities and combinations into a receptacle, wherein each intermediate storage unit comprises at least one inlet housing for communication with a respective storage container, and a storage vessel for communication with said inlet housing and with the respective pump unit and means for venting said inlet housing and said storage vessel to ambient gas, and wherein each dispensing unit comprises a dispensing nozzle of resilient material and actuable by the pressure from said pump unit only.

2. A device according to claim 1 wherein the storage container is a bottle, in use held inverted in a bottle holder, and wherein the inlet housing is arranged to sealingly receive an outlet portion of the bottle holder.

3. A device according to claim 2 wherein the bottle holder is in the form of a clamp comprising a shaft having a fixed bottom leg for engagement with a bottom of a bottle, and a member slidable on the shaft and provided with said outlet portion for engagement with an opening of the bottle.

4. A device according to claim 3 wherein the storage unit is provided with a guide channel to receive a free end of said shaft of the bottle holder.

5. A device according to claim 3 wherein said member slidable on the shaft has a manually releasable locking mechanism acting on the shaft.

6. A device according to claim 3 wherein each storage unit comprises locking means for locking said bottle holder mounted onto a corresponding inlet housing.

7. A device according to claim 6 wherein a spring loaded retaining member is provided on the storage unit for engagement with said shaft or said member slidable on the shaft.

8. A device according to claim 7 wherein said retaining member comprises a plate having an aperture, opposite edges of the aperture being arranged to clamp said shaft by tilting the plate relative to the shaft.

9. A device according to claim 5 wherein said manually releasable locking mechanism comprises a second plate having an aperture the opposed edges of which by tilting the second plate relative to the shaft are adapted to clamp the shaft, a pivotable actuation means for the locking mechanism forming a link having one end pivotally connected to an end of the plate and a second end guided in a recess, for changing the angular orientation of the plate to clamp or release the shaft on operation of the actuation means.

10. A device according to claim 2 wherein said outlet portion of the bottle holder has an outwardly flared mouth for receiving the opening of the bottle.

11. A device according to claim 2 wherein a valve being spring-urged to a closed position is provided within said outlet portion of the bottle holder, said valve having a valve member arranged to be retracted to an open position by engagement with a fixed stop or a bottom within the inlet housing when the bottle holder is mounted on the inlet housing.

12. A device according to claim 2 wherein said outlet portion of the bottle holder is arranged to extend a distance into said intermediate storage unit.

13. A device according to claim 11 wherein said storage units comprise adjustable holder means arranged to hold said bottle holder in a stand-by position on the inlet housing and to allow lowering of the bottle holder to an operating position on the inlet housing.

14. A device according to claim 1 wherein said storage container is connected to the intermediate storage unit via a pipe conduit.

15. A device according to claim 1 wherein said intermediate storage unit comprises at least one venting opening.

16. A device according to claim 15 wherein said venting opening is in communication with a container for an inert gas.

17. A device according to claim 1 wherein said intermediate storage unit is provided with at least one photoelectric level sensor.

18. A device according to claim 1 wherein each storage unit comprises a plurality of inlet housings coupled in series.

19. A device according to claim 1 wherein each pump unit comprises a piston pump operated by a step motor on dispensing only and wherein the dispensed amount of beverage is determined solely by regulating the piston stroke of the pump.

20. A device according to claim 19 wherein the piston of said pump is arranged to be fully retracted immediately after each stroke.

21. A device according to claim 1 wherein each nozzle has a tube-like configuration including a pair of opposite substantially planar wall portions converging to an outlet end and contacting each other at the outlet end in a closed state of the nozzle.

22. A device according to claim 21 wherein opposite lateral edges of said wall portions are thickened in a bead-like manner.

23. A device according to claim 1 wherein said units are formed as replaceable module-components and wherein units having mutually equivalent function are grouped in blocks.

24. A device according to claim 1 wherein said check valves are formed as unidirectional sealing lips made of resilient material and contacting the walls of the bore.

25. A device for selectively dispensing and mixing a plurality of beverages, having separately for each beverage a storage unit, a pump unit and a dispensing unit, said units for each beverage being connected in series by pipe conduits, the dispensing units being combined so as to provide a bundle to dispense and mix the beverages in selected quantities and combinations into a receptacle, wherein each storage unit comprises an intermediate storage unit provided between a storage container and a respective pump unit and arranged to receive a volume of beverage larger than the volume dispensable on each operation by the pump unit via said dispensing unit, wherein each dispensing unit comprises a dispensing nozzle of resilient material and openable by the pressure from said pump unit only; and wherein each pump unit comprises a pump valve assembly of plug-in type including a housing having a cylindrical bore, whereby an inlet port, a pumping port and an outlet port extend into the cylindrical bore, and including a valve body insertable into said bore, said valve body having a first check valve arranged between the pump port and the inlet port and having a second check valve arranged between the outlet port and inlet port.

26. A device according to claim 25 wherein said check valves are formed as unidirectional sealing lips made of resilient material and contacting the walls of the bore.

27. A device for selectively dispensing and mixing a plurality of beverages, having separately for each beverage a storage unit, a pump unit and a dispensing unit, said units for each beverage being connected in series by pipe conduits, each storage unit comprising an intermediate storage unit provided between a storage container and a respective pump unit and arranged to receive a volume of beverage larger than the volume dispensable on each operation by the pump unit via said dispensing unit, and said dispensing units being combined so as to provide a bundle to dispense and mix the beverages in selected quantities and combinations into a receptacle, wherein each pump unit comprises a pump valve assembly of plug-in type including a housing having a cylindrical bore, whereby an inlet port, a pumping port and an outlet port extend into the cylindrical bore, and including a valve body insertable into said bore, said valve body having a first check valve arranged between the pump port and the inlet port and having a second check valve arranged between the outlet port and inlet port.

* * * * *